US010106375B1

(12) United States Patent
Ascua et al.

(10) Patent No.: US 10,106,375 B1
(45) Date of Patent: Oct. 23, 2018

(54) SPLIT VACUUM ELEVATOR SYSTEM

(71) Applicants: Carlos M. Ascua, Parana (AR); Juan Carlos de Ledebur, Miami, FL (US)

(72) Inventors: Carlos M. Ascua, Parana (AR); Juan Carlos de Ledebur, Miami, FL (US)

( * ) Notice: Subject to any disclaimer, the term of this patent is extended or adjusted under 35 U.S.C. 154(b) by 0 days.

(21) Appl. No.: 15/673,509

(22) Filed: Aug. 10, 2017

(51) Int. Cl.
*B66B 9/04* (2006.01)
*B66B 11/04* (2006.01)

(52) U.S. Cl.
CPC ..... *B66B 9/04* (2013.01); *B66B 11/0423* (2013.01)

(58) Field of Classification Search
CPC ..... B66B 9/04; B66B 11/0423
See application file for complete search history.

(56) References Cited

U.S. PATENT DOCUMENTS 494,217 A * 3/1893 Miles ..... B66B 11/0423 187/251
2,927,661 A * 3/1960 Kristek ..... B66B 9/04 187/273
4,284,032 A * 8/1981 Moos ..... B05B 7/1404 118/308
5,076,737 A * 12/1991 Loutsch ..... F16K 1/24 406/183
5,583,326 A * 12/1996 Sors ..... B66B 9/04 182/48
5,593,347 A * 1/1997 Mandy ..... B66B 11/024 187/393
5,718,627 A * 2/1998 Wicks ..... F24F 11/0001 454/68
6,085,873 A * 7/2000 Macchi ..... B66B 9/04 187/273
6,106,379 A * 8/2000 Mosca ..... B24B 37/30 156/345.14
6,311,718 B1 * 11/2001 Hafner ..... F16K 31/08 137/205
6,322,295 B1 * 11/2001 Gabriele ..... B65G 51/02 406/151
6,360,768 B1 * 3/2002 Galler ..... E03D 5/09 137/205
7,322,200 B2 * 1/2008 Sorensen ..... A47F 3/04 221/150 R
9,845,155 B2 * 12/2017 Brown ..... B64D 9/00
2002/0029938 A1 * 3/2002 Sors ..... B66B 9/04 187/345
2008/0298906 A1 * 12/2008 Scott ..... B65G 51/20 406/12
2014/0238781 A1 * 8/2014 Ascua ..... B66B 9/04 187/250
2017/0190424 A1 * 7/2017 Brown ..... B64D 9/00

* cited by examiner

*Primary Examiner* — Michael A Riegelman
(74) *Attorney, Agent, or Firm* — Patent CEO, LLC; Phillip F. Vales

(57) ABSTRACT

A Split Vacuum Elevator System has a channel connecting a vacuum elevator cylinder or thoroughfare to an electric equipment housing having motors and valves for the operation thereof. The channel is attached at a top of the elevator thoroughfare through a raised protrusion (or more raised protrusions if there are more then one channel) in a sealing plate that is itself attached to the support structure of the thoroughfare. The other side of the channel is connected to an air buffer known as a collector. This collector has one or more protrusions to connect to one or more channels. A raised lip on the collector facilitates the attachment of the housing thereto.

20 Claims, 5 Drawing Sheets

SPLIT VACUUM ELEVATOR SYSTEM

FIELD OF THE INVENTION

The present invention relates to an elevator system; more particularly, the present invention relates to a vacuum elevator system whereby the components of the system are easy to locate in a business or private home.

BACKGROUND OF THE INVENTION

Elevators typically use countervailing weights in order to facilitate a passenger cabin moving up and down an elevator shaft in large office buildings, hospitals, factories and similar structures. These types of elevators require a great deal of space, maintenance, equipment and machinery. More recently, a new type of elevator has been developed known as a vacuum elevator system. This elevator uses air pressure to cause the motion of the cabin within a thoroughfare or tubular cylinder that uses the air within it as a working fluid upon the confines of the cabin. Brakes, motors, valves, electronic controls and other equipment work in concert to ensure a safe and pleasant riding experience for each occupant therein.

However, it has become apparent that even though modern vacuum elevator systems reduce the number of components necessary, their installation in homes and businesses requires a rethinking of the current architecture. Typically, a modern vacuum elevator system as known in the prior art has motors in a container as well as a valve located directly at the top of the elevator main cylinder. As shown in prior art FIG. 7, the motor equipment container 7 and a valve 7B are situated within a decorative cylinder 7Z having a circular bottom plate (upon which sits container 7 and valve 7B) attached at the bottom portion of the cylinder 7Z; this bottom plate is further attached to the support structure of the elevator cylinder.

It should be appreciated that the motor equipment container 7 has two vents 7D integrated on its side for air transfer. The container 7 also has perforations on its underside that match openings within circular bottom plate; this thereby permits air to flow from the elevator main cylinder through openings in the circular bottom plate on through perforations in container 7 out through two vents 7D and to the environment for upwards motion. Another pathway is also used for control of the cabin position such that air passes through valve 7B out through a bottom hole in the valve and a corresponding hole in the bottom plate of cylinder 7Z and into the elevator main cylinder for downwards motion. In this fashion, air flow acting under influence of motors located in the container 7 translates the cabin up and down the cylinder; thus, the container perforations and corresponding openings within circular bottom plate are crucial to cabin motion control.

A typical example of this type of disposition is shown in U.S. Pat. No. 9,162,848 to Ascua et al and U.S. Pat. No. 9,248,995 to Ascua et al. (FIG. 9A) both of which are hereby incorporated by reference. Additionally, U.S. Pat. No. 9,248,995 teaches an alternative system in FIG. 9B which locates motors and other equipment within a remotely located box; thus, the patent teaches an equipment box sitting atop a ledge on a wall, on the floor, on the roof of a home or similar implementation. This device forms a stable box whereby piping would supposedly attached from this box to the cylinder which in turn facilitates the control of air within the cylinder.

However, whilst the system was originally contemplated as a direct connection from box to cylinder using piping, it became apparent that the appropriate flow of air within the piping from the box to the cylinder and back did not provide for precise control of the cabin motion.

Additionally, since the box had several perforations at its bottom it became apparent that to mount the box remotely, the piping would interfere with the surface upon which the box was mounted making it difficult if not impossible to appropriately mount the box thereon whilst at the same time connecting the piping. This because it would require cutting surfaces or interfering with existing structures within the home or business.

Finally, during installation of the elevator cylinder at different locations, it became clear that the container 7 and housing 7Z mounted to the top of the cylinder would not fit into the location; thus the installation could not be accomplished.

Accordingly, there needs to be some solution to overcome the aforementioned problems.

SUMMARY OF THE INVENTION

The present invention overcomes the deficiencies of the known art and the problems that remain unsolved by providing A Split Vacuum Elevator System as described herein and in the accompanying drawings.

A split vacuum elevator system comprising:

a vacuum elevator cabin thoroughfare having an air transmission channel attached thereto; and an air control equipment housing indirectly attached to the air transmission channel wherein the air control equipment housing comprises:

a first air control equipment compartment integral with an integral valve support ledge;

wherein the integral valve support ledge has an air control valve attached thereto and supported thereon; and wherein the first air control equipment compartment has electric motors therein.

In another aspect, further comprising:

a sealing plate attached to the vacuum elevator cabin thoroughfare and to the air transmission channel.

In another aspect, wherein the sealing plate further comprises:

a first air transmission channel connector.

In another aspect, wherein the sealing plate further comprises:

a second air transmission channel connector.

In another aspect, wherein the sealing plate further comprises:

a first air transmission raised protrusion.

In another aspect, wherein the sealing plate further comprises:

a second air transmission raised protrusion.

In another aspect, further comprising:

an intermediate collector situated between-the air transmission channel and the air control equipment housing; such that the intermediate collector is attached to both the air transmission channel and the air control equipment housing.

In another aspect, wherein the air control equipment housing is mounted atop the intermediate collector.

In another aspect, wherein the intermediate collector is directly attached to the air transmission channel through a protrusion integrally formed from the intermediate collector.

In another aspect, further comprising:

an air control equipment housing mounting lip along a top of the intermediate collector.

In another aspect, wherein the intermediate collector further comprises:

an air transmission channel connecting first opening at a side of the intermediate collector thereof.

In another aspect, wherein the intermediate collector further comprises:

an air transmission channel connecting second opening at a side of the intermediate collector thereof.

A split vacuum elevator system comprising:

a vacuum elevator cabin thoroughfare having an air control equipment housing indirectly attached to the vacuum elevator cabin thoroughfare;

a vacuum valve attached to the air control equipment housing; and an air motion buffer indirectly attached to the vacuum elevator cabin thoroughfare and wherein the air motion buffer is directly attached to the air control equipment housing; and wherein the vacuum valve is distinct from the air motion buffer.

In another aspect, further comprising:

an air transmission channel directly attached to the vacuum elevator cabin thoroughfare and to the air motion buffer.

In another aspect, further comprising:

a sealing plate attached to the vacuum elevator cabin thoroughfare and to the air transmission channel.

In another aspect, further comprising:

a sealing plate attached to the vacuum elevator cabin thoroughfare and indirectly to the air motion buffer.

A vacuum elevator intermediate collection system comprising:

a vacuum elevator cabin thoroughfare indirectly attached to:

an intermediate air transmission enclosure having an air transmission opening at a top thereof;

an air control equipment housing integrally supported and attached to:

an equipment housing mounting lip integral with the intermediate air transmission enclosure and situated along a top of the intermediate air transmission enclosure; and wherein the vacuum elevator cabin thoroughfare is indirectly attached to the intermediate air transmission enclosure through:

a first channel connection port opening at a side of the intermediate air transmission enclosure.

In another aspect, further comprising:

a second opening at a side of the intermediate air transmission enclosure; wherein the vacuum elevator cabin thoroughfare is indirectly attached to the intermediate air transmission enclosure through the second opening.

In another aspect, further comprising:

wherein the intermediate collector is directly attached to a first end of an air transmission channel; and a second end of the air transmission channel is connected to the vacuum elevator cabin thoroughfare.

In another aspect, wherein the air control equipment housing further comprises:

a motorized air flow first hole on its underside; and a vacuum valve control second hole on its underside.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
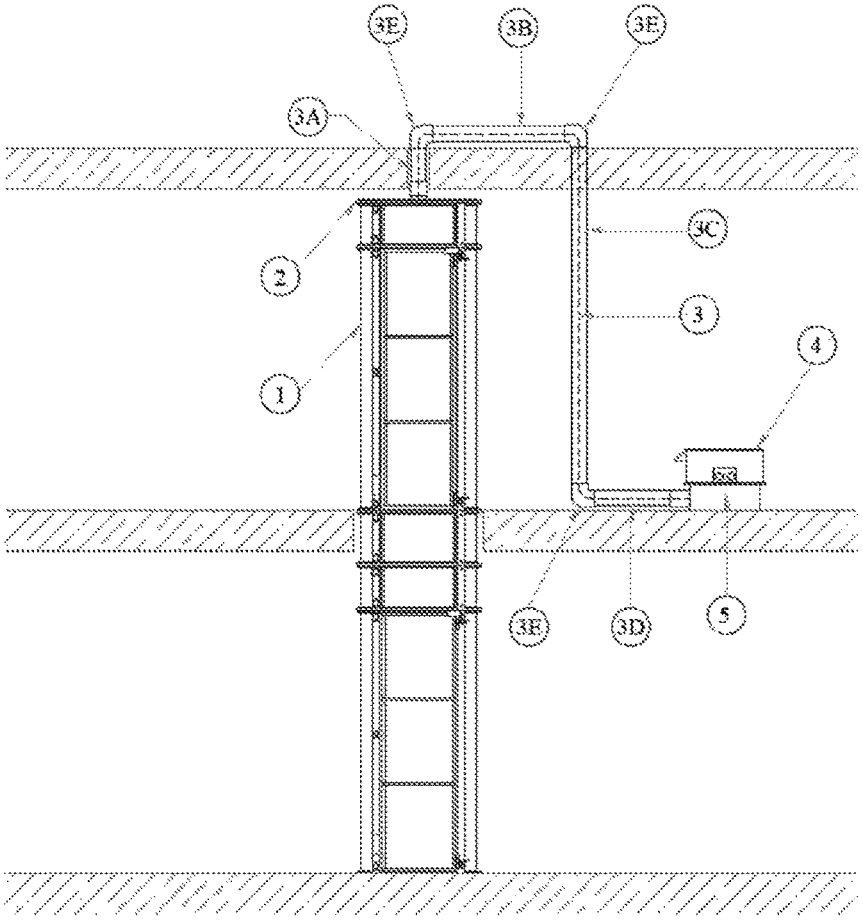
FIG. 1 illustrates a pneumatic vacuum elevator showing an elevator cylinder 1 that also has a cabin (not shown) inserted within the cylinder amongst several floors as well as the Split Vacuum Elevator System as described in an embodiment disclosed herein.

FIG. 1 illustrates a pneumatic vacuum elevator showing an elevator cylinder 1 that also has a cabin (not shown) inserted within the cylinder 1 amongst several floors as well as the Split Vacuum Elevator System as described in an embodiment disclosed herein. The elevator cylinder 1 is made from curved polycarbonate sheets and built around an aluminum structure. As shown, the attached figures utilize what is called a Split Vacuum Elevator System. The Split Vacuum Elevator System has several components including but not limited to an elevator cylinder 1, a plate 2, channel 3, equipment housing or simply housing 4 and a collector 5. This novel system remotely installs the air suction devices and other controls at location away from the elevator cylinder 1 and its associated passenger cabin that is disposed within the elevator cylinder 1. Further, the air suction and other controls are mounted on a support surface such as a floor, wall ledge, dedicated mount or similar mounting device that is suitable for this purpose.

As these are remotely disposed away from the elevator cylinder and cabin, they are connected to the cylinder through the use of PVC piping. The Split Vacuum Elevator System has a housing 4 having electric motors and a vacuum valve externally that facilitates the flow of air thereby creating differential pressure that is transmitted to the top of the elevator via the use of channel 3 typically made from PVC. As a result, the cabin is able to rise or fall within the cylinder. In order to attach the channel 3 to the top of the elevator cylinder 1, an adaptor is necessary so as to fix the channel 3 thereto.

Thus, the top of the elevator cylinder 1 has an adaptor made from a plate 2 (shaped as a circle in this example) welded or otherwise attached to the support structure of the cylinder 1 having one or more appropriate piping protrusions; this protrusion(s) attaches to channel 3 and provides a seal at the top of the elevator cylinder 1. It should be appreciated that the Split Vacuum Elevator System uses suitable mounts and fasteners as necessary to supporting structures in the house or business so as to appropriately stabilize the channel 3 until it reaches the housing 4.

In order to complete the Split Vacuum Elevator System, the installation of a housing 4 away from the elevator cylinder 1 uses a collector 5 as an intermediate stage for air flow control as well as a firm support under the housing 4 holding air flow motors and a vacuum valve externally on a ledge. In this fashion, the collector 5 acts as a buffer or reservoir system to help the Split Vacuum Elevator System to produce the required negative and positive air pressure for the ascent or descent of the cabin (not shown). Various situations necessitate this system such as when the cylinder 1 top is too close to the ceiling thereby forbidding the attachment of a housing. Thus, the housing 4 needs to be located remotely and since it has holes in its bottom portion a collector 5 has to be disposed underneath it for proper air flow and support.

The collector 5 is alternatively installed in any room of any floor different to the one where the elevator is located, or on any floor associated with the elevator cylinder inserted therein. Of course to accomplish this, one must install channel 3 between the main elevator cylinder 1 plate 2 through appropriate holes in the various floors that it needs to pass through; this as well as mounts and fasteners to supporting structures in the house or business where the elevator is located. The result is the appropriate stabilization of channel 3 until it reaches the collector 5 having the housing 4 mounted upon it. A typical channel 3 connection distance is 10 meters but variations on this distance are possible.

Further, channel 3 is most generally composed of one or more pipes transiting between the plate 2 and the collector 5. However, testing has shown that the most effective air flow is found utilizing 2 separate channels of appropriate dimensions disposed along similar or even parallel directions and cutting through various floors and walls as appropriate to reach the collector 5. In this disclosure, the word channel is used to mean a complete tubular connection from the plate 2 to the collector 5 regardless of the number of tubes, pipes, slip fittings, elbow joints or other connectors there between.

In order to connect channel 3 from elevator cylinder 1 plate 2 until the channel 3 reaches collector 5, various pipes, tubes, fittings, elbow fittings, fittings, and other connections are used. A typical example is shown in FIG. 1. As such, it should be appreciated that typical PVC adhesives, glues or similar modalities are utilized to connect the various pipes, fittings, joints together in order to ensure an air tight seal. Further, it should be understood from the above discussion that one or more channels 3 are possible and that for each channel 3 a distinct protrusion would be necessary on plate 2 as well as a distinct protrusion on collector 5. Further, appropriate piping is to be used from each protrusion on plate 2 to a similar collector 5 protrusion. Of course, as discussed it is preferable to have two distinct channels.

First, an end of a first linear tube 3A is inserted within the mouth of an integral protrusion of plate 2 initiating a vertical channel 3 direction proceeding upwards. The plate itself is circular in this description but any shape is possible according to the implementation. Next, the other end of first linear tube 3A is inserted within a first elbow fitting 3E which has another end as well.

This other end of the first elbow fitting 3E has an end of a second linear tube 3B inserted therein such that the channel 3 proceeds to the right horizontally in the drawing. The second linear tube 3B has another end that is inserted into an end of a second elbow fitting 3E which also has another end. This other end of the second elbow fitting 3E has an end of a third linear tube 3C inserted therein such that the channel 3 proceeds downwards vertically; the third linear tube 3C has another end that is inserted into an end of a third elbow fitting 3E which also has another end.

This another end of the third elbow fitting 3E has an end of a fourth linear tube 3D inserted therein such that the channel 3 proceeds to the right horizontally; finally the fourth linear tube 3D is inserted into a protrusion extending out from the collector 5. The collector 5 of course has one or more protrusions extending out therefrom as appropriate to the number of channels 3 that are contemplated but preferably two protrusions on collector 5 for two distinct channels 3 are envisioned. These of course correspond with the other end of the channel 3, that is, plate 2, having two protrusions for the two distinct channels 3.

Figure 2A:
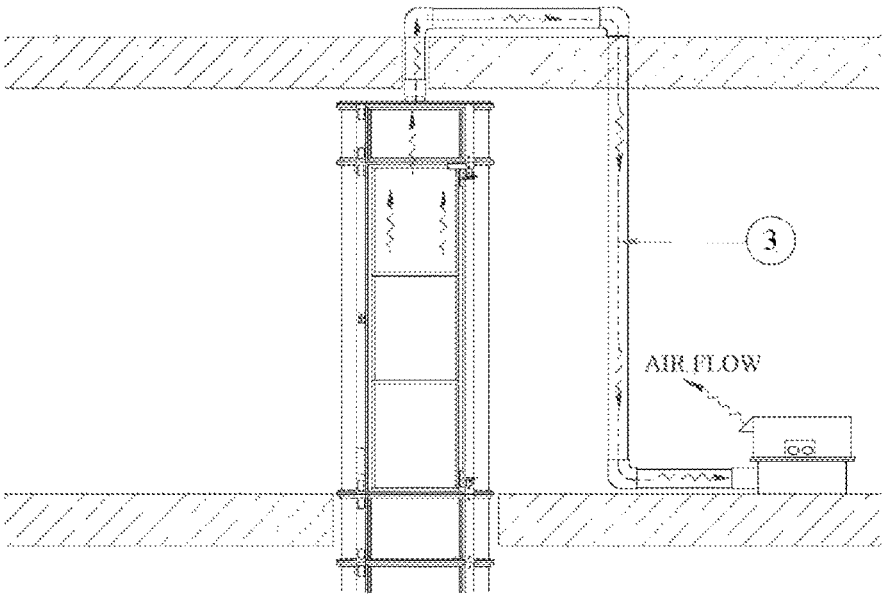
FIG. 2A presents an ascending operation of the Split Vacuum Elevator System as described in an embodiment disclosed herein.

FIG. 2A presents an ascending operation of the Split Vacuum Elevator System as described in an embodiment disclosed herein. The controller (not shown) sitting atop housing 4 commands the turbine motors to turn on which are located within housing 4. As shown in FIG. 2A, the turbine motors create negative pressure through the collector 5. Thus, air is withdrawn from the elevator cylinder 1 using channel 3 through collector 5 and out through the housing 4 thereby causing a depression inside the cylinder permitting the cabin within the cylinder 1 to move upward therein.

Figure 2B:
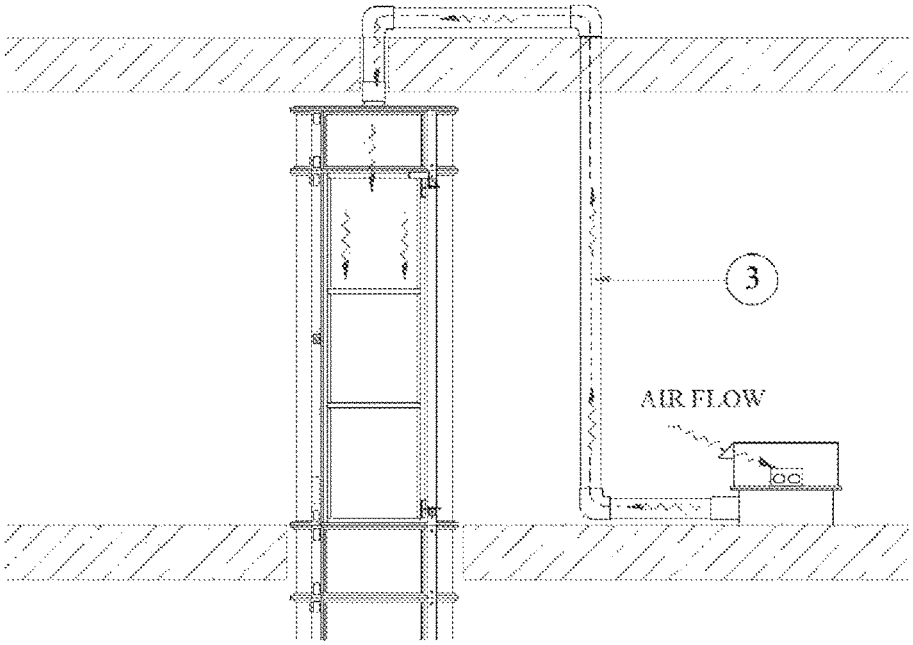
FIG. 2B presents a descending operation of the Split Vacuum Elevator System as described in an embodiment disclosed herein.

FIG. 2B presents a descending operation of the Split Vacuum Elevator System as described in an embodiment disclosed herein. The controller (not shown) sitting atop housing 4 commands a vacuum valve located thereon to draw air into the cylinder 1. As shown in FIG. 2B, the vacuum valve thereby draws air into valve on into the collector 5. Thus, air enters through the vacuum valve on into collector 5 through channel 3 and into elevator cylinder 1. In so doing, this operation causes positive pressure which causes the descent of the car within the cylinder 1.

Figure 3:
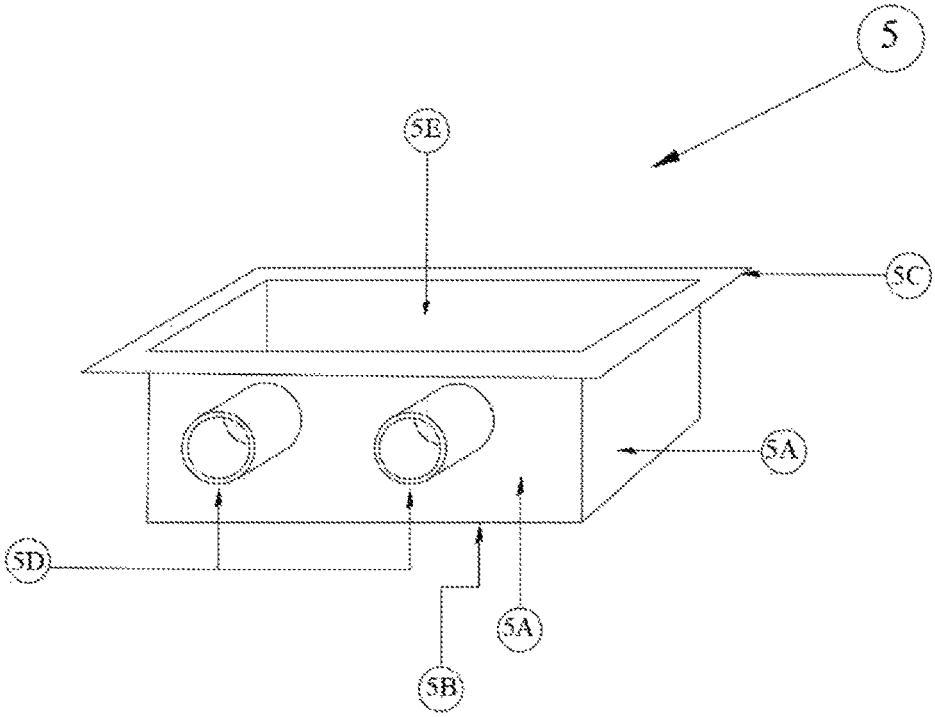
FIG. 3 presents a collector 5 of the Split Vacuum Elevator System as described in an embodiment disclosed herein.

FIG. 3 presents a collector 5 of the Split Vacuum Elevator System as described in an embodiment disclosed herein. FIG. 3 shows collector 5 being formed as a rectangular container having four side walls 5A though other shapes are possible. Each side wall 5A has two vertical edges and two horizontal edges; each side wall 5A is integrated along a first vertical edge thereof with a vertical edge of a previous side wall 5A and each side wall 5A is also integrated along its second vertical edge to a succeeding side wall 5A vertical edge until the rectangular shape is formed. Further, a rectangular bottom 5B of the collector 5 has four edges that each integrate to one of the bottom horizontal edges of the four side walls 5A.

The top of the collector 5 has a lip 5C or flange that is formed integrally with the top horizontal edges of each of the four side walls 5A; this lip extends horizontally outwards forming a perimeter support for attaching the housing 4 thereto using glues, adhesives, fasteners or similar modalities. Finally, the collector 5 has a main opening 5E circumscribed by the lip 5C that helps smoothly draw air into and out of the housing as well as the channel 3 and ultimately the elevator cylinder permitting descent and ascent of the cabin therein.

Finally, one or more protrusions 5D are integrally formed on a side wall 5A and extend out horizontally therefrom for attachment to the channel 3 using piping and glues, adhesives or similar modalities. It should be understood that the collector 5 is formed from fiberglass, plastics, polymers, metals, MDF or similar materials.

Figure 4A:
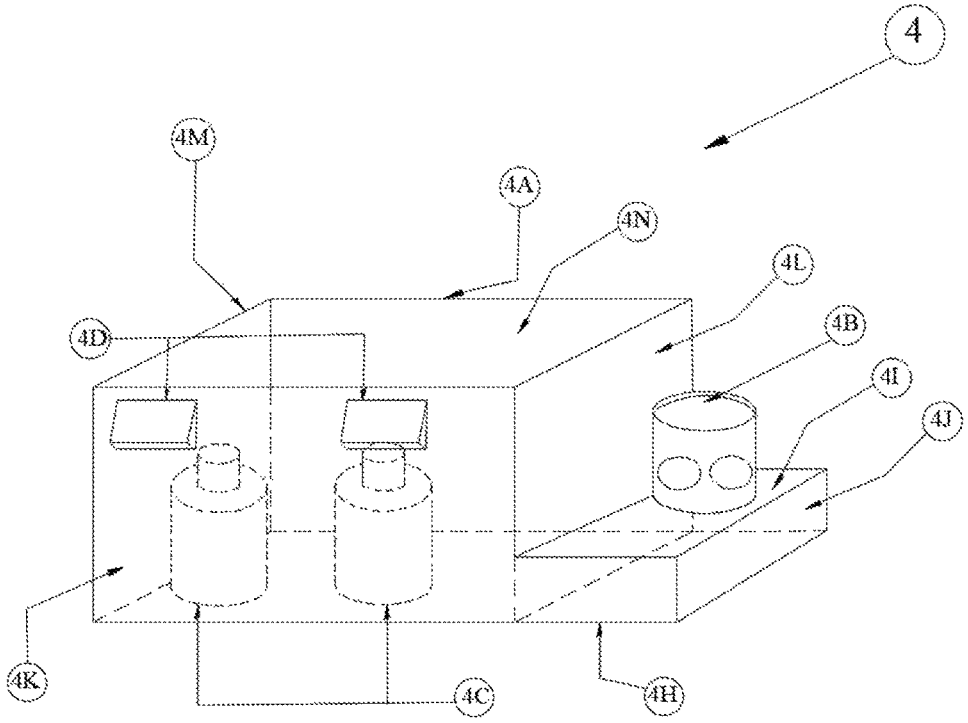
FIG. 4A presents a front perspective view of the housing 5 in an embodiment disclosed herein.

FIG. 4A presents a front perspective view of the housing 4 in an embodiment disclosed herein. FIG. 4A represents the housing 4 holding the turbine motors causing air motion in the elevator cylinder 1 as well as an integral vacuum valve 4B on an external portion that extends outwards to the right in the drawing. In FIG. 4A, a left part of the housing 4 contains the motors 4C and other necessary items such as wiring that goes out holes therein as needed. On a side 4K of housing 4 are one or more vents 4D that are openings for air outflow having an angled air protector or hood.

More particularly, the housing has two separate compartments for control of air motion, a left and a right compartment; the left compartment has the motors 4C (and holes for any necessary motor wiring and seals not shown) whilst the right compartment serves as a mount for a vacuum valve 4B and passageway for air therethrough. The left compartment has four vertical side walls 4A, 4M, 4K, 4L. Each side wall 4A, 4M, 4K, 4L has two vertical edges and two horizontal edges; each side wall is integrated along a first vertical edge thereof with a vertical edge of a previous side wall and each side wall is also integrated along its second vertical edge to a succeeding side wall vertical edge until the rectangular shape is formed. Further, a rectangular bottom side formed separately from the right compartment (or from a portion of a total bottom surface 4H) has four edges that each integrate to one of the bottom horizontal edges of the four side walls 4A, 4M, 4K, 4L. The top four horizontal edges of the four side walls 4A, 4M, 4K, 4L integrate with the sides of a top side 4N thereby forming a left compartment.

Similarly, the right compartment is formed from a slab of material having a top surface 4I, a right surface 4J, a small front surface, a small back surface and a bottom surface (or formed from a portion of a total bottom surface 4H). These are typically formed from a slab of material and connected together against the right large side 4L of the left compartment. A hole under the vacuum valve 4B penetrates the slab permitting air flow there through. Alternatively, the different surfaces described respecting the right compartment slab are actually separate sheets of material and form a box with the left side of the box being a portion of the right side surface 4L of the left compartment. In this alternative there is an open space between these sheets of material instead of a simple hole therethrough.

Figure 4B:
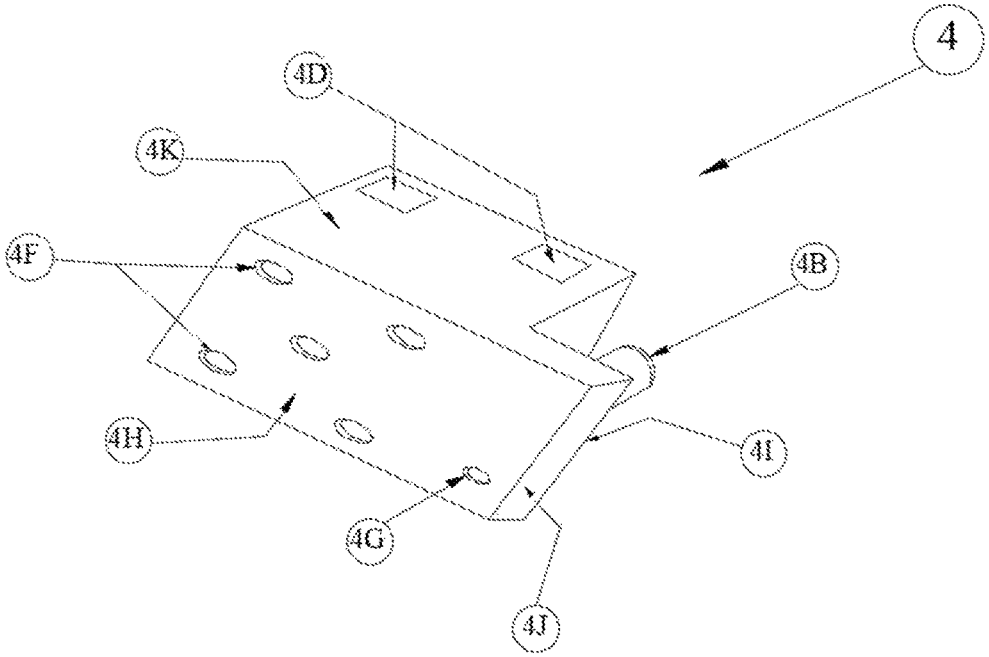
FIG. 4B presents a bottom perspective view of the housing 5 as taught in an embodiment disclosed herein.

FIG. 4B presents a bottom perspective view of the housing 4 as taught in an embodiment disclosed herein. Items 4F are holes in the bottom of the housing 4 in the enclosed space of the left compartment for the Turbine Motors to suction air from the elevator cylinder 1. Item 4G is the hole for the Vacuum Valve to release vacuum pressure by permitting air to flow into the valve 4B, into the collector 5 through the channel 3, plate 2 and into the cylinder 1. Thus, it should be generally understood that the housing 4 houses or is integrally associated with electric motors 4C or turbines, a vacuum valve 4B that regulates the descent of the elevator, as well as an electrical control housing (not shown) above the housing 4 wherein the controller board, breakers and other electrical protection device are placed. With the help of various sensors installed all over the system the turbine motors are controlled and operated in a synchronized way to ensure smooth and safe operation of the vacuum elevator.

Figure 5:
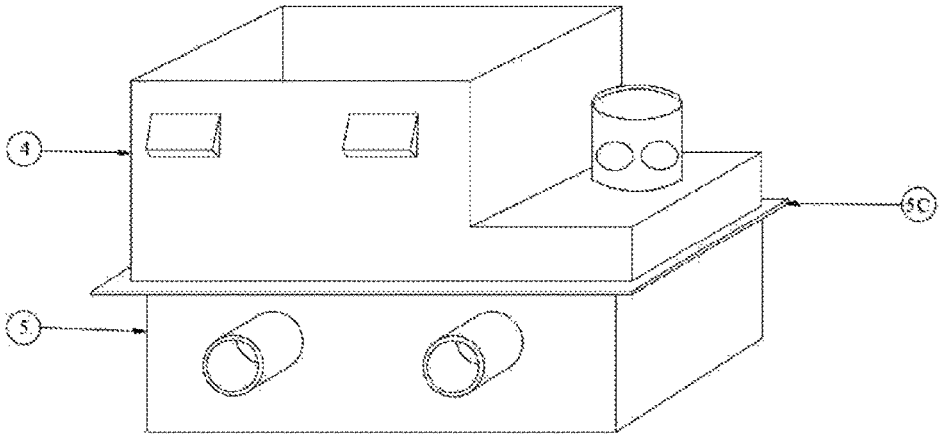
FIG. 5 presents a front perspective view of the housing 4 mounted atop of the collector 5 using the lip 5C of the collector 5 as an attachment point for the underside of the housing 4.

FIG. 5 presents a front perspective view of the housing 4 mounted atop of the collector 5 using the lip 5C of the collector 5 as an attachment point for the underside of the housing 4. The housing 4 is attached to the collector using glues, adhesives, fasteners or similar modalities as needed in the implementation.

Figure 6:
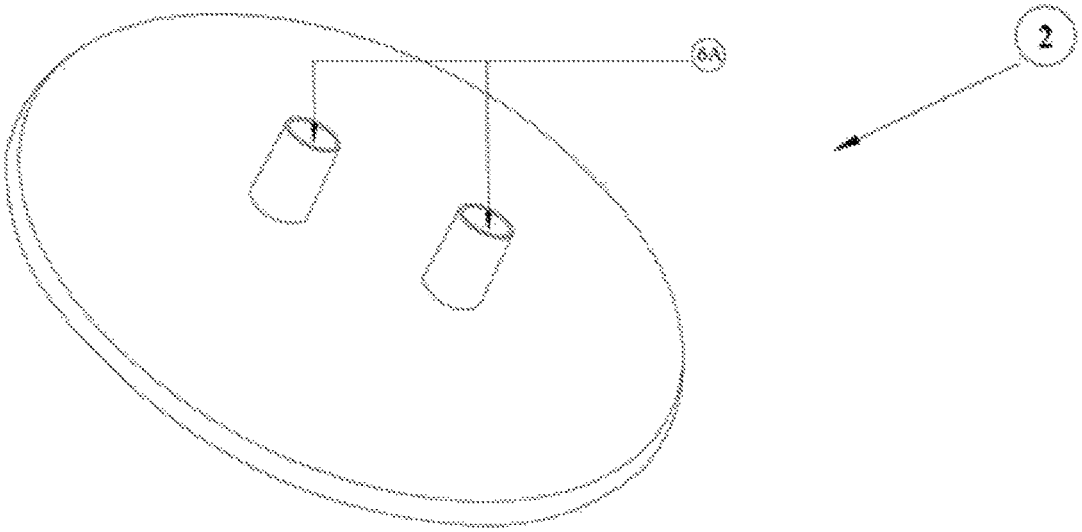
FIG. 6 represents the plate 2 which is attaches to the top of the elevator cylinder 1 support structure made from aluminum.
Figure 7:
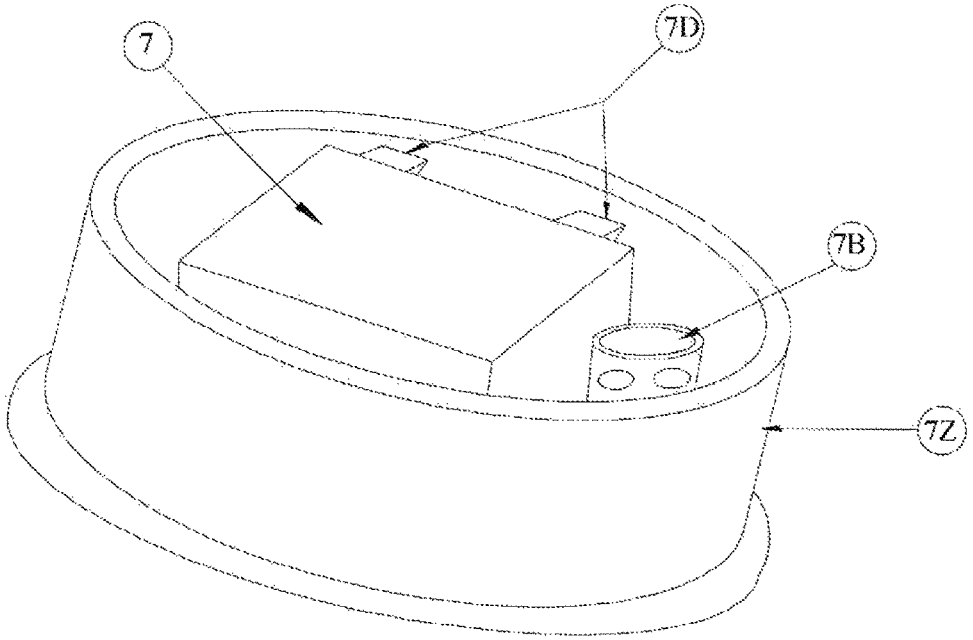
FIG.7 PRIOR ART
FIG. 7 presents a view of a prior art housing for an equipment container that is mounted to the top of an elevator cylinder.

FIG. 6 represents the plate 2 which is attaches to the top of the elevator cylinder 1 support structure made from aluminum. This plate 2 is placed on top of the cylinder to seal the cylinder thereby maintaining vacuum and air pressure as appropriate. Item 6A are the integral protrusions necessary to attach to tubes, pipes or similar members for moving air along channel 3.

It should be understood that the various devices found herein are formed from fiberglass, plastics, polymers, metals, MDF, PVC or similar materials.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A split vacuum elevator system comprising:

a vacuum elevator cabin thoroughfare having an air transmission channel attached thereto; and an air control equipment housing indirectly attached to the air transmission channel wherein the air control equipment housing comprises:

a first air control equipment compartment integral with an integral valve support ledge;

wherein the integral valve support ledge has an air control valve attached thereto and supported thereon; and wherein the first air control equipment compartment has electric motors therein.

2. The split vacuum elevator system of claim 1, further comprising:

a sealing plate attached to the vacuum elevator cabin thoroughfare and to the air transmission channel.

3. The split vacuum elevator system of claim 2, wherein the plate further comprises:

a first air transmission channel connector.

4. The split vacuum elevator system of claim 3, wherein the plate further comprises:

a second air transmission channel connector.

5. The split vacuum elevator system of claim 2, wherein the sealing plate further comprises:

a first air transmission raised protrusion.

6. The split vacuum elevator system of claim 5, wherein the sealing plate further comprises:

a second air transmission raised protrusion.

7. The split vacuum elevator system of claim 1, further comprising:

an intermediate collector situated between the air transmission channel and the air control equipment housing; such that the intermediate collector is attached to both the air transmission channel and the air control equipment housing.

8. The split vacuum elevator system of claim 7, wherein the air control equipment housing is mounted atop the intermediate collector.

9. The split vacuum elevator system of claim 7, wherein the intermediate collector is directly attached to the air transmission channel through a protrusion integrally formed from the intermediate collector.

10. The split vacuum elevator system of claim 7, further comprising:

an air control equipment housing mounting lip along a top of the intermediate collector.

11. The split vacuum elevator system of claim 7, wherein the intermediate collector further comprises:

an air transmission channel connecting first opening at a side of the intermediate collector thereof.

12. The vacuum elevator collector assembly of claim 11, wherein the intermediate collector further comprises:

an air transmission channel connecting second opening at a side of the intermediate collector thereof.

13. A split vacuum elevator system comprising:

a vacuum elevator cabin thoroughfare having an air control equipment housing indirectly attached to the vacuum elevator cabin thoroughfare;

a vacuum valve attached to the air control equipment housing; and an air motion buffer indirectly attached to the vacuum elevator cabin thoroughfare and such that the air motion buffer is directly attached to the air control equipment housing; and wherein the vacuum valve is distinct from the air motion buffer.

14. The split vacuum elevator system of claim 13, further comprising:

an air transmission channel directly attached to the vacuum elevator cabin thoroughfare and to the air motion buffer.

15. The split vacuum elevator system of claim 14, further comprising:

a sealing plate attached to the vacuum elevator cabin thoroughfare and to the air transmission channel.

16. The split vacuum elevator system of claim 13, further comprising:

a sealing plate attached to the vacuum elevator cabin thoroughfare and indirectly to the air motion buffer.

17. A vacuum elevator intermediate collection system comprising:

a vacuum elevator cabin thoroughfare indirectly attached to:

an intermediate air transmission enclosure having an air transmission opening at a top thereof;

an air control equipment housing integrally supported and attached to:

an equipment housing mounting lip integral with the intermediate air transmission enclosure and situated along a top of the intermediate air transmission enclosure; and wherein the vacuum elevator cabin thoroughfare is indirectly attached to the intermediate air transmission enclosure through:

a first channel connection port opening at a side of the intermediate air transmission enclosure.

18. The vacuum elevator intermediate collection system of claim 17, further comprising:

a second opening at a side of the intermediate air transmission enclosure; wherein the vacuum elevator cabin thoroughfare is indirectly attached to the intermediate air transmission enclosure through the second opening.

19. The vacuum elevator intermediate collection system of claim 17, further comprising:

wherein the intermediate collector is directly attached to a first end of an air transmission channel; and a second end of the air transmission channel is connected to the vacuum elevator cabin thoroughfare.

20. The vacuum elevator intermediate collection system of claim 19, wherein the air control equipment housing further comprises:

a motorized air flow first hole on its underside; and a vacuum valve control second hole on its underside.

* * * * *